United States Patent [19]

Tanaka

[11] Patent Number: 4,711,506

[45] Date of Patent: Dec. 8, 1987

[54] SOCKET OF ELECTROSTATIC PROTECTION TYPE

[75] Inventor: Masanori Tanaka, Osaka, Japan

[73] Assignee: Hosiden Electronics Co., Ltd., Osaka, Japan

[21] Appl. No.: 8,065

[22] Filed: Jan. 13, 1987

Related U.S. Application Data

[63] Continuation of Ser. No. 738,333, May 28, 1985, abandoned.

[51] Int. Cl.[4] ..... H01R 4/66

[52] U.S. Cl. ..... 439/108

[58] Field of Search ..... 339/14 R, 14 T, 111

[56] References Cited

U.S. PATENT DOCUMENTS 3,688,239 8/1972 Jaconette ..... 339/14 R
3,723,948 3/1973 Wyatt et al. ..... 339/14 R
4,375,307 3/1983 Rock ..... 339/14 R
4,407,552 10/1983 Watanabe et al. ..... 339/143 R
4,568,133 2/1986 Amano et al. ..... 339/14 R

*Primary Examiner*—Gil Weidenfeld
*Assistant Examiner*—Gary F. Paumen
*Attorney, Agent, or Firm*—Armstrong, Nikaido, Marmelstein & Kubovcik

[57] ABSTRACT

A socket of an electrostatic protection type provided with an earth spring formed of an elastic metal material, the earth spring having a back to be fitted at both lengthwise ends thereof into a groove provided at the plugging surface of a body formed of insulating material and legs bent from both ends of said back in the widthwise direction of said body, the legs being earthed on the basis of contact with the metal plate to be connected to an earth when inserted into the body, the back being exposed outwardly from the plugging surface of the body when the earth spring is fitted into the groove.

6 Claims, 8 Drawing Figures

SOCKET OF ELECTROSTATIC PROTECTION TYPE

This application is a continuation of application Ser. No. 738,333 filed May 28, 1985, now abandoned.

BACKGROUND OF THE INVENTION

This invention relates to a socket and more particularly to a socket of an electrostatic protection type used for input and output of an electric signal, and in detail to a socket which is adapted to ground the static electricity stored in the user's body before a plug is plugged into the socket, when part of user's body, for example, the finger, approaches the socket, and prior to discharge of the static electricity from the finger across to signaling leads at the socket.

DESCRIPTION OF THE PRIOR ART

Recently, control equipment has often incorporated in its electric circuit electronic parts, such as integrated circuits, which cannot withstand an electrostatic shock.

Since the up-to-date electronic circuits often process very weak signals, the socket to be connected to such electronic circuit employs an grounded fitting for electrostatic protection.

There is a typical socket of the aforesaid type is provided with an grounded fitting, a body, a frame, and bolts and nuts for connecting them.

In detail, this kind of socket comprises three main components: The metallic grounded fitting of, for example, balancing type bar, the body of insulating material which has a groove formed at the center of the plugging surface at the socket and insertably engageable with the grounded fitting and which has a plurality of signaling leads, and a metallic frame mounted on a casing incorporating therein the electric circuit, and bolts and nuts for connecting the above components, the grounded fitting, body and frame having aligned bores through which the bolts are insertable respectively.

Accordingly, the grounded fitting and casing are electrically connected through the bolts inserted through the bores and tightened by nuts from below, in which the components are separate from each other until they are assembled.

Hence, each component will be individually fed into the assembly process for the socket (for example, by use of a separate feeder), thereby creating a problem in that the assembly process is difficult to automate.

Another problem is created in that, for example, there is a problem that there may be either too many parts or missing parts prior to the assembly of the socket.

SUMMARY OF THE INVENTION

An object of the invention is to provide a socket of an electrostatic protection type which is conductive of the static electricity from the human body with an ground spring prior to conduction of the same with signaling leads to thereby protect the signaling leads from being affected by the static electricity.

Another object of the invention is to provide a socket of an electrostatic protection type which can assemble the ground spring, body and frame integrally with each other without using the tighting parts, such as bolts and nuts.

Still another object of the invention is to provide a novel socket of an electrostatic protection type which is suitable for automation of the assembly process of the socket with the casing.

These and other objects of the invention will become more apparent in the detailed description and examples which follow.

DETAILED DESCRIPTION OF THE INVENTION

Figure 1:
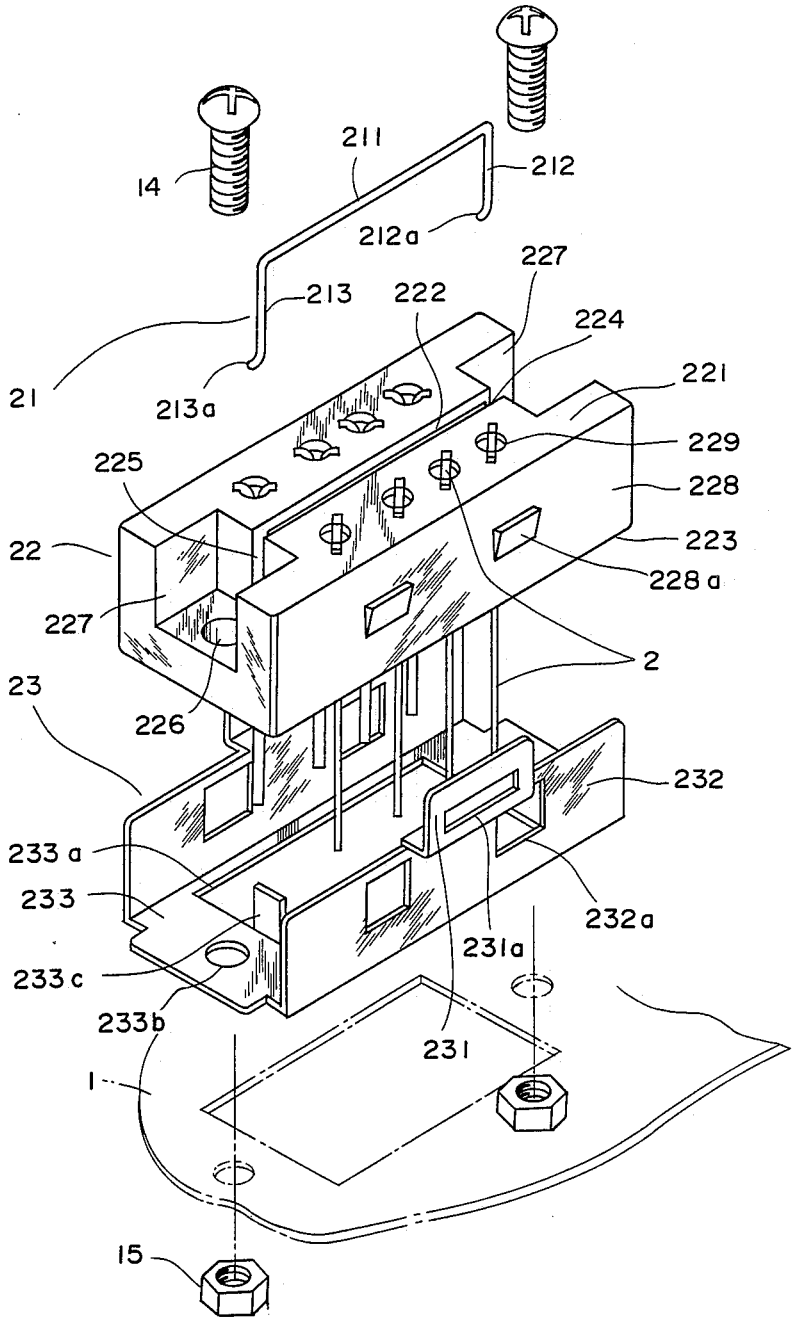
FIG. 1 is a perspective exploded view of an embodiment of a socket of the invention.
Figure 2:
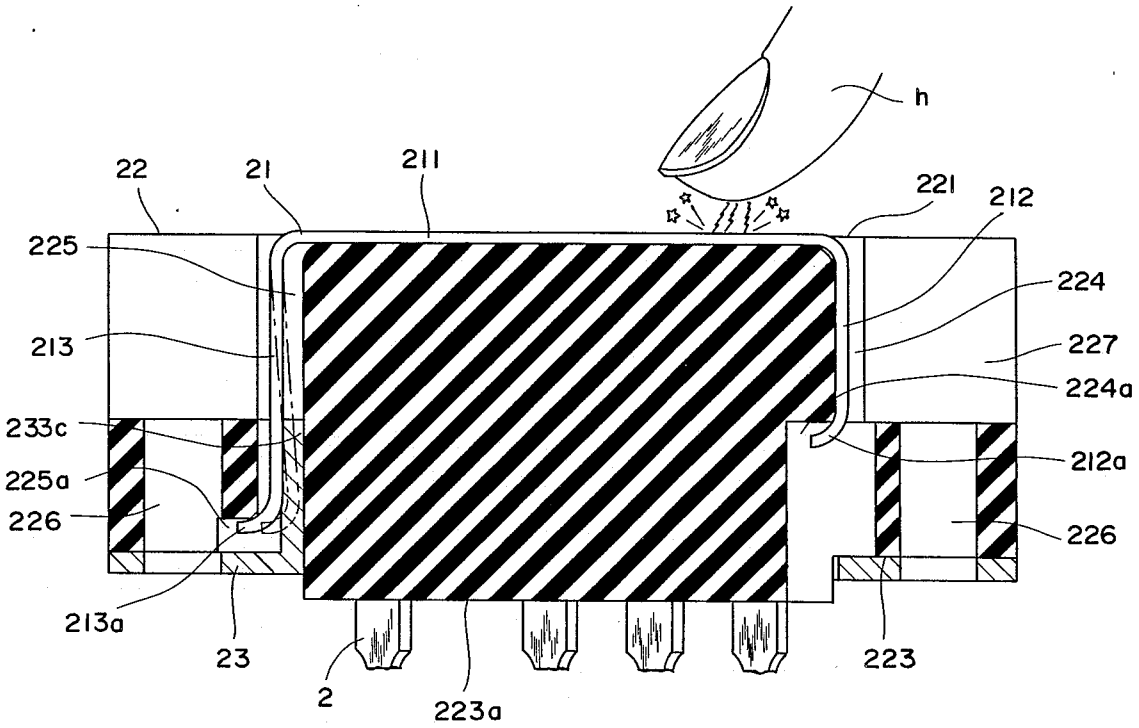
FIG. 2 is a longitudinal sectional view of the central portion of the socket in FIG. 1.

Referring to FIGS. 1 and 2, the socket of the invention is shown which comprises a ground spring 21, a body 22, a frame 23, bolts 14 and nuts 15.

The ground spring 21 is formed of an elastic wire, such as a piano wire, bent as shown. In detail, the ground spring 21 comprises a back or straight portion 211 for receiving the static electricity from the human body, a short straight leg 212 bent at one end (the right hand end in the drawing) and extending lengthwise of body 22, and a longer straight leg 213 bent at the other end (at the left hand end) at an approximate angle of 80° and extending lengthwise of the body 22. The legs 212 and 213 are bent at the tips **212*a* and 213*a*** at angles of 90°, both tips bent in the same direction (leftwardly in the drawing) respectively.

The body 22 is approximately rectangular and laterally symmetrical with respect to the lengthwise center and is molded of insulating resin.

In detail, the body 22 is so constructed that at the upper surface 221 of body 22 to be plugged, a groove 222 is positioned at the widthwise center. The groove 22 extends lengthwise of body 22, and receives the straight portion 211 of ground spring 21 which is exposed by about $\frac{1}{3}$ of its thickness. The groove 222 has at both ends vertical cutouts 224 and 225 perforating to the lower surface 223 of body 22 and horizontal cutout extensions **224*a* and 225*a* engageable with the inwardly bent tip 212*a* and the outwardly bent tip 213*a*. The body 22 is provided at both lengthwise ends with recesses 227 which are bored by bores 226 for bolts 14 to mount the socket on the casing 1**.

Also, the body 22 is provided on both lateral sides of groove 222 with bores 229 into which contacts 2 which serve as signaling leads are inserted. At the lower surface and side surfaces of body 22 a projection **223*a* and triangular projections 228*a* are engageable with the frame 23** respectively.

The frame 23 is formed laterally symmetrical with respect to the lengthwise center with the body 22. The frame 23 is punched from a thin metal plate to be discussed below and bent to cover the body 22 as shown.

Namely, the frame 23 is provided at both widthwise sides with a pair of rectangular joints 231 with a punched-out portion 231*a* each in a rectangular shape. The side plates 232 of frame 23 are for covering the side surfaces 228 of body 22 by about ⅔ of thickness. The side plates 232 contain two rectangular bores 232*a* which are engageable with the triangular projections 228*a* at both side surfaces 228 of the body 22.

Furthermore, the frame 23 is provided at the base plate 233 thereof with a rectangular opening 233*a* engageable with the lower projection 223*a* of body 22. A tongue 233*c* of frame 23 is bent vertically to be inserted into the vertical cutout 225 of the body 22. Bores 233*b* are aligned with the bolt bores 226 of the body 22 respectively.

Next, an explanation will follow on assembly of the socket of the invention.

At first, the straight portion 211 of ground spring 21 is, as shown in FIG. 2, fitted into the groove 222 in the body 22. In this case, the groove 222 is of smaller depth than the diameter of the ground spring wire so that the straight portion 211 is exposed in part above the plugging surface 221. On the other hand, the short leg 212 and long leg 213 (shown by the one-dot-chain line) of the ground spring 21 are fitted into the vertical cutouts 224 and 225 respectively.

Next, the frame 23 is fitted onto the body 22 from the bottom thereof. The tongue 223C of the frame 23 is forcibly inserted between the longer leg 213 and the inner surface of cutout 225. The bent tip 213*a* shifts toward the cutout extension 225*a* as shown by the solid line in FIG. 2, whereby the frame 23 is electrically connected with the ground spring 21. Simultaneously, the rectangular bores 232*a* on the side plates of frame 23 engage with the triangular projections 228*a* on the side surfaces of body 22 respectively so that the body 22 is tightly fitted in the frame 23.

The conventional socket is different from the socket of the invention in that the components of the conventional socket are separate prior to assembly while the ground spring, body and frame of the socket of the invention are already integral with each other prior to assembly. Such an assembled socket is incorporated in a casing 1 through bolts 14 and nuts 15.

For example, before a plug (not shown) is inserted into the socket, static electricity is charged in the user's finger h. When the user's finger is close to the socket, the static electricity is discharged across to the straight portion 211 of the ground spring, but is not discharged to the contacts. The static electricity reaches the casing 1 via the longer leg 213, tongue 233C and frame 23, and then is grounded through the grounded casing 1.

Hence, electronic parts, such as the integrated circuit, which cannot withstand an electrostatic shock, even when connected electrically with the contacts of signaling leads, are protected completely from the electrostatic shock.

Figure 3:
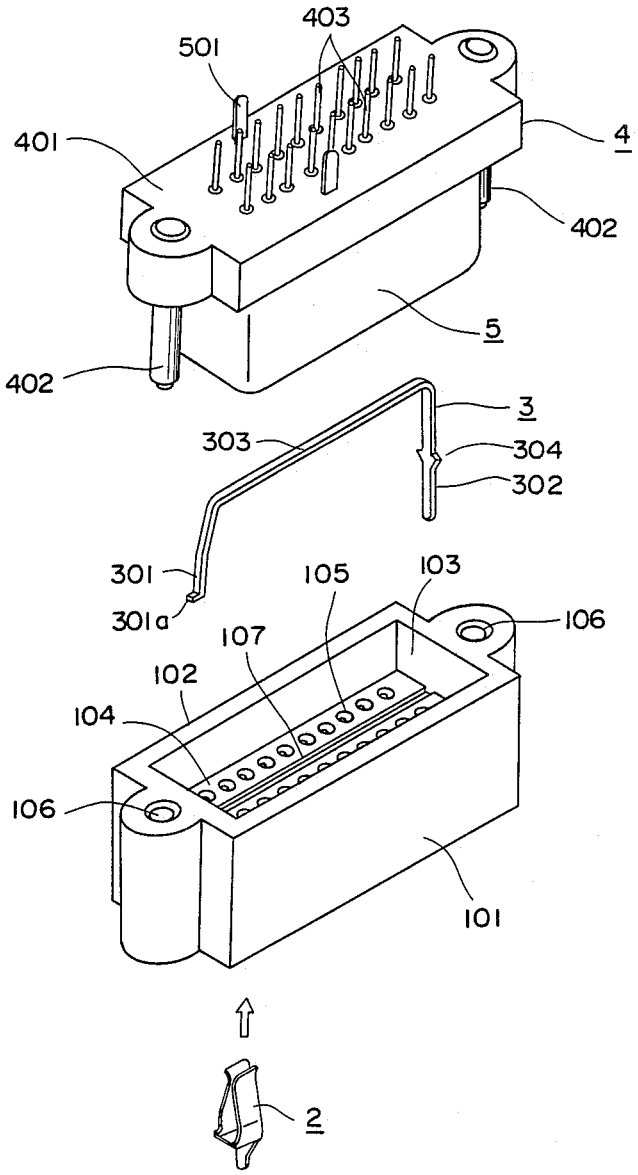
FIG. 3 is a perspective exploded view of a modified embodiment of a socket including a plug.
Figure 4:
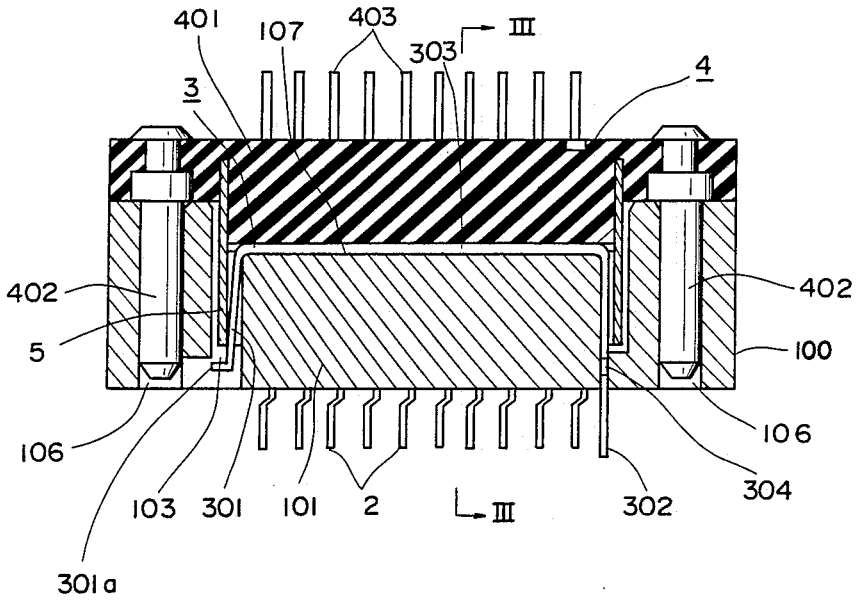
FIG. 4 is a sectional front view of the FIG. 3 embodiment in assembly condition.
Figure 5:
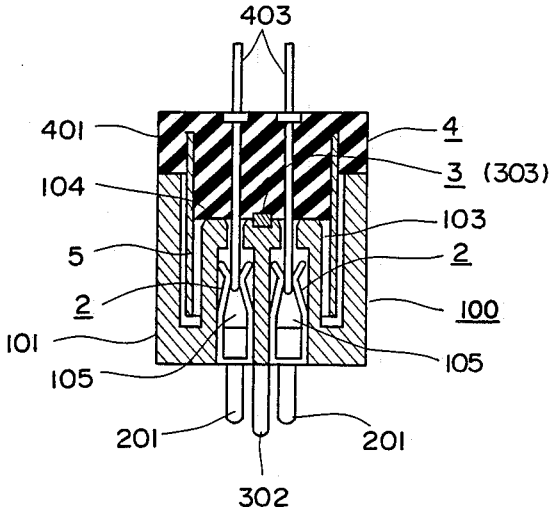
FIG. 5 is a sectional view taken on the line III—III in FIG. 4.

A modified embodiment of the socket and plug of the invention is shown in FIG. 3, in which a socket body 101 is provided with a groove 107 corresponding to the aforesaid groove 222. The body 101 is formed with a groove 103 rectangularly surrounded by the outer walls 102. The rectangular inner surface surrounding the groove 103 serves as a plugging surface 104. The plugging surface 104 is provided with a plurality of vertical bores 105 disposed in two rows for inserting the contact 2 into the bores 105 respectively as shown in FIGS. 4 and 5. The body 101 is provided at both lengthwise ends with vertical positioning bores 106.

The ground spring 3 is formed of an elastic punched metal plate and comprises a back or straight body 303, a short leg 301 bent at one end of body 303 widthwise thereof, and a long leg 302 bent at the other end of the body 303 perpendicularly widthwise thereof. The long leg 302 extends at the lower end downwardly from the lower surface of body 101. The leg 301 has a bent tip 301*a* bending outwardly at a slight angle. The leg 302 is straight at the tip and provided at an intermediate portion with a triangular retainer 304. The tip of leg 302 is connected electrically to the casing or a ground point at an electric circuit to be incorporated in the casing 100.

A plug 4 comprises a body 401 formed of insulating material and is fitted into the socket body 101, a ground member 5 of a metallic frame is fitted into the surrounded groove 103 at the socket body 101. A plurality of plugging contacts 403 is inserted into the bores 105 bored at the plugging surface 104 respectively. Ground segments 501 project upwardly from the upper surface of plug body 401. The plug body 401 is provided at both lengthwise ends with positioning pins 402 to be fitted into the vertical positioning bores 106 on the socket body 101 respectively.

Figure 6:
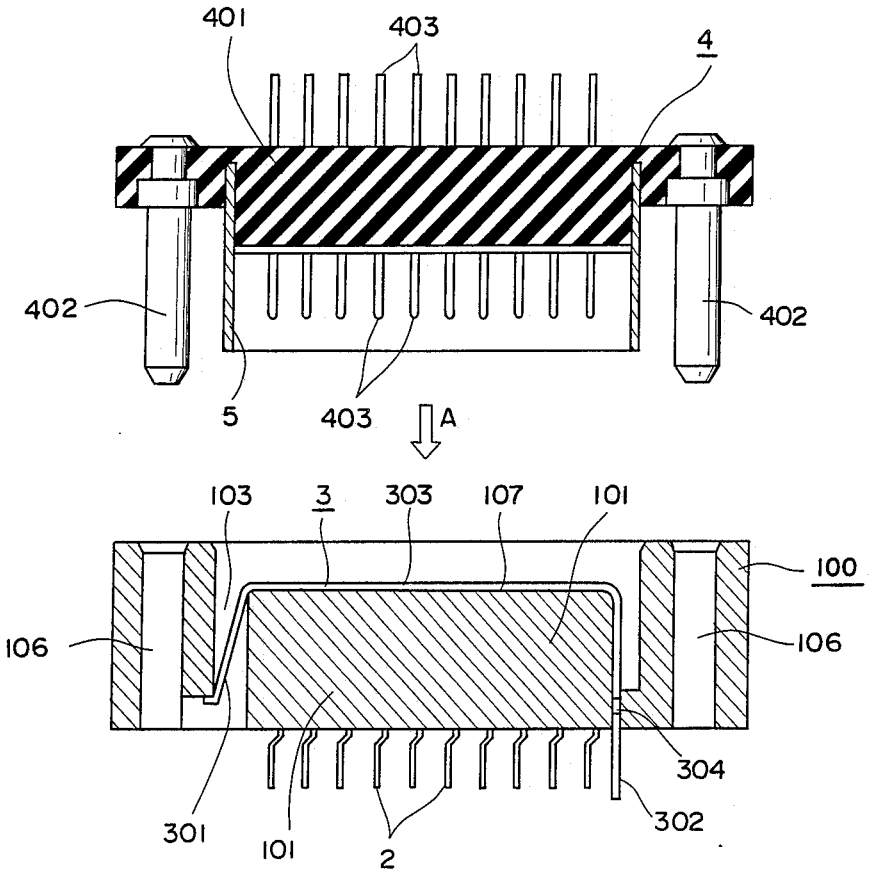
FIG. 6 is an illustration of the use of the socket and plug in FIG. 3.

The plug 4, as shown in FIG. 6, is inserted into the socket 100 in the direction of the arrow A, whereby the socket 100 and plug 4 are mechanically connected with each other to be kept in electrical contact as shown in FIGS. 4 and 5.

In other words, when the positioning pins 402 are fitted into the vertical positioning bores 106 on the socket 100 in the direction of the arrow A respectively, the plug contacts 403 are connected to the contacts 2 corresponding thereto respectively, and simultaneously the ground member 5 is fitted into the groove 103. The lower end of earth member 5 comes into slidable contact with the short leg 301 of ground spring 3 (refer to FIG. 4) so that the short leg 301 holds by its elastic restoring force (the force acting leftwardly in FIG. 4) the ground member 5 and ground spring 3 in contact with each other.

In other words, the socket 100 in the modified embodiment, as seen from FIG. 6, is so constructed that the ground spring 3 and socket body 101 are integral with each other without using bolts and nuts.

Figure 7:
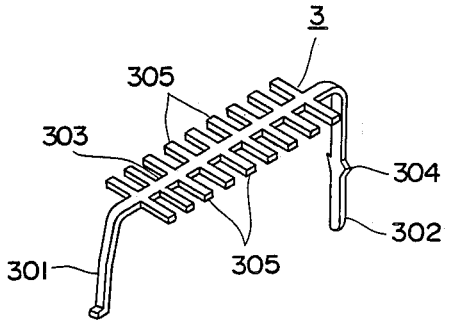
FIG. 7 shows a modified embodiment of a ground spring used for the socket in FIG. 1 or 3.
Figure 8:
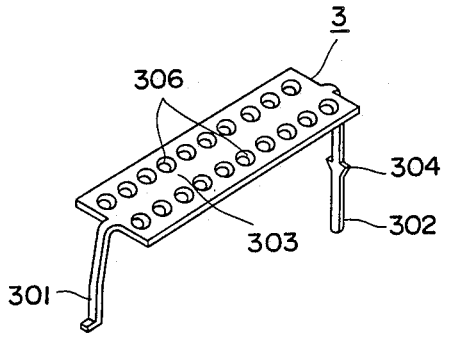
FIG. 8 shows another modified embodiment of the ground spring.

In addition, the ground spring used in the embodiments in FIGS. 1 and 3 may, for example as shown in FIG. 7, be formed of a plurality of ribs 305 projecting laterally from both sides of spring body 303, or may be formed of a flat plate as shown in FIG. 8. In FIG. 7, the ribs 305 are spaced to allow the plug contacts 403 to be insertable between the respective ribs 305. In FIG. 8, the flat plate 303 has insertion bores 306 for the plug contacts respectively.

I claim:

1. A socket for protection of circuits and the like from weak currents that will damage the main connection function of said circuits and the like, said socket comprising:

socket body means having a plug connecting surface with a plurality of contact means arranged on both sides of a groove means provided on said plug connecting surface, said socket body means having vertical cut-out means, said socket body means formed of insulating material;

electrically conductive frame means into which said socket body means is tightly fitted, said frame means having metal plate means which is inserted into said vertical cut-out means of said socket body means, said metal plate means being connected to ground; and ground spring means of elastic metallic material having a back portion to be fitted into said groove means on said plug connecting surface of said socket body means and having legs which are bent at both lengthwise ends of said back portion, said legs being inserted into said vertical cut-out means of said socket body means such that said metal plate means is forcibly inserted between at least one of said legs and a wall of said vertical cut-out means of said socket body means, said at least one of said legs being grounded by being in elastic contact with said metal plate means forming an elastic engaging portion, said ground spring means being outwardly exposed at said back portion when said ground spring means is fitted into said groove means on said plug connecting surface of said socket body means.

2. A socket of an electrostatic protection type according to claim 1, wherein said ground spring is formed of an elastic metal wire.

3. A socket of an electrostatic protection type according to claim 1, wherein said ground spring means legs have tips which are each bent at an angle of at least 90°.

4. A socket of an electrostatic protection type according to claim 3, wherein said socket body means has horizontal cutout extensions engageable with said bent leg tips of said ground spring means.

5. A socket of an electrostatic protection type according to claim 1, wherein said socket body means has projections engageable with said frame means.

6. A socket according to claim 1, wherein said ground spring means is integral at said legs thereof with said back portion and wherein one of said legs is longer than the other of said legs, said legs being bent at the tips to be engagable with said socket body means.

* * * * *